US009134033B2

(12) United States Patent
Nevarez et al.

(10) Patent No.: US 9,134,033 B2
(45) Date of Patent: Sep. 15, 2015

(54) OPEN LOOP GAS BURNER

(75) Inventors: Roberto Nevarez, Hudson, FL (US); Douglas S. Jones, New Port Richey, FL (US)

(73) Assignee: GARLAND COMMERCIAL INDUSTRIES L.L.C., Freeland, PA (US)

( * ) Notice: Subject to any disclaimer, the term of this patent is extended or adjusted under 35 U.S.C. 154(b) by 94 days.

(21) Appl. No.: 12/355,662

(22) Filed: Jan. 16, 2009

(65) Prior Publication Data

US 2009/0188484 A1 Jul. 30, 2009

Related U.S. Application Data

(60) Provisional application No. 61/011,520, filed on Jan. 18, 2008.

(51) Int. Cl.

| | |
|---|---|
| ***F23D 14/70*** | (2006.01) |
| ***F23D 14/34*** | (2006.01) |
| *F23D 14/02* | (2006.01) |
| *F24C 3/08* | (2006.01) |

(52) U.S. Cl.

CPC ..... *F24C 3/085* (2013.01); *F23D 14/02* (2013.01); *F23D 14/34* (2013.01); *F23D 14/70* (2013.01)

(58) Field of Classification Search

CPC ..... F23D 14/70; F23D 14/02; F23D 14/34; F23D 2203/102; F23D 2203/103; F23D 2203/105; F23C 3/085; F23C 7/008

USPC .. 126/116 R, 19 R, 273 R, 39 H, 39 N, 39 K, 126/40; 239/553, 553.3, 553.5, 565, 566, 239/568; 431/354, 353, 7; 138/37–46

See application file for complete search history.

(56) References Cited

U.S. PATENT DOCUMENTS

| | | | | | |
|---|---|---|---|---|---|
| 594,251 | A | * | 11/1897 | Henderson | 431/354 |
| 640,427 | A | * | 1/1900 | Stephenson | 126/40 |
| 854,491 | A | * | 5/1907 | Haggerty et al. | 126/39 E |
| 973,498 | A | * | 10/1910 | Geurink | 431/278 |
| 1,044,131 | A | * | 11/1912 | Brown | 239/556 |
| 1,151,188 | A | * | 8/1915 | Kelly | 126/39 R |
| 1,170,509 | A | * | 2/1916 | Burnham | 239/549 |

(Continued)

FOREIGN PATENT DOCUMENTS

| | | |
|---|---|---|
| AU | 2009210553 B2 | 8/2012 |
| CH | 189501 A | 2/1937 |

(Continued)

OTHER PUBLICATIONS

Rejection issued by Chinese Patent Office on Oct. 15, 2012 for Chinese Patent Application Number, 200980102470.6, pp. 6.

(Continued)

*Primary Examiner* — Gregory Huson
*Assistant Examiner* — Daniel E Namay
(74) *Attorney, Agent, or Firm* — Ohlandt, Greeley, Ruggiero & Perle, L.L.P.

(57) ABSTRACT

A gas burner has an air-gas mixture distribution section with an open loop geometry and a plurality of sides. The air-gas mixture distribution section has a top heating surface and a plurality of ports are disposed on the top heating surface. An inlet is disposed on one of the plurality of sides of the air-gas mixture distribution section and a distribution diffuser is mounted inside the air-gas mixture distribution section.

12 Claims, 7 Drawing Sheets

(56) References Cited

U.S. PATENT DOCUMENTS

| | | | | | |
|---|---|---|---|---|---|
| 1,187,260 | A * | 6/1916 | Child | 126/39 R |
| 1,224,157 | A * | 5/1917 | Fry | 431/286 |
| 1,231,391 | A * | 6/1917 | Lehman | 126/36 |
| 1,328,589 | A * | 1/1920 | Roberts | 431/278 |
| 1,379,701 | A * | 5/1921 | Schmilowitz | 126/85 R |
| 1,416,500 | A * | 5/1922 | Nicolaus | 239/556 |
| 1,556,140 | A * | 10/1925 | Wolf | 105/364 |
| 1,589,993 | A * | 6/1926 | Otto et al. | 239/543 |
| 1,597,116 | A * | 8/1926 | Skinner | 126/40 |
| 1,764,719 | A * | 6/1930 | Gercich | 126/39 E |
| 1,781,386 | A | 11/1930 | Harner et al. | |
| 1,789,430 | A * | 1/1931 | Dibble | 126/39 E |
| 1,791,509 | A * | 2/1931 | Morrow | 239/553 |
| 1,862,660 | A * | 6/1932 | Clynch | 126/116 R |
| 1,967,606 | A * | 7/1934 | Brown | 431/349 |
| 2,025,458 | A * | 12/1935 | Klein | 239/553.3 |
| 2,081,560 | A * | 5/1937 | Rogers | 126/36 |
| 2,257,888 | A * | 10/1941 | Parsons | 126/39 R |
| 2,300,156 | A * | 10/1942 | Higley | 431/44 |
| 2,304,140 | A * | 12/1942 | Bergholm | 126/39 G |
| 2,438,996 | A * | 4/1948 | Greene | 431/347 |
| 2,488,388 | A * | 11/1949 | Evans | 236/15 A |
| 2,898,846 | A * | 8/1959 | Del Francia | 99/443 R |
| 3,270,967 | A * | 9/1966 | Westerman et al. | 239/560 |
| 3,476,315 | A * | 11/1969 | Biggle | 236/15 A |
| 3,624,352 | A * | 11/1971 | Deaton et al. | 219/448.17 |
| 3,626,923 | A * | 12/1971 | Martin | 126/41 R |
| 3,638,635 | A * | 2/1972 | Drennan | 126/41 R |
| 3,881,858 | A * | 5/1975 | Fitzgerald | 431/348 |
| 4,039,275 | A * | 8/1977 | McGettrick | 431/329 |
| 4,083,355 | A * | 4/1978 | Schwank | 126/39 J |
| 4,092,975 | A * | 6/1978 | Grammatopoulos | 126/41 R |
| 4,137,905 | A | 2/1979 | Longworth | 126/350 |
| 4,305,372 | A * | 12/1981 | Hahn | 126/41 R |
| 4,437,833 | A * | 3/1984 | Mertz | 431/329 |
| 4,478,205 | A * | 10/1984 | Koziol | 126/25 R |
| 4,598,691 | A * | 7/1986 | Herrelko et al. | 126/41 R |
| 4,622,946 | A * | 11/1986 | Hurley et al. | 126/39 E |
| 4,901,705 | A * | 2/1990 | Takata et al. | 126/41 R |
| 4,919,116 | A * | 4/1990 | Pfefferkorn | 126/41 R |
| 4,960,101 | A * | 10/1990 | Home | 126/41 R |
| 5,062,408 | A * | 11/1991 | Smith et al. | 126/41 R |
| 5,062,788 | A * | 11/1991 | Best | 431/7 |
| 5,127,824 | A * | 7/1992 | Barker | 431/284 |
| 5,154,160 | A * | 10/1992 | Burtea et al. | 126/21 A |
| 5,295,476 | A * | 3/1994 | Herbert | 126/39 G |
| 5,711,663 | A * | 1/1998 | Giebel et al. | 431/354 |
| 6,102,029 | A * | 8/2000 | Stephen et al. | 126/41 R |
| 6,200,131 | B1 * | 3/2001 | Birch et al. | 431/155 |
| 6,230,701 | B1 * | 5/2001 | Schultheis et al. | 126/39 J |
| 6,553,986 | B1 * | 4/2003 | Liu | 126/41 R |
| 6,561,795 | B1 | 5/2003 | Lasagni et al. | 431/354 |
| 6,672,302 | B1 | 1/2004 | Voorhis et al. | |
| 6,676,041 | B1 * | 1/2004 | McLoughlin et al. | 239/565 |
| 6,699,036 | B2 * | 3/2004 | Schlosser et al. | 431/354 |
| 6,705,307 | B2 * | 3/2004 | Alden et al. | 126/41 R |
| 6,945,774 | B2 * | 9/2005 | Shoeb | 431/354 |
| 7,082,941 | B2 | 8/2006 | Jones et al. | 126/39 H |
| 2004/0018465 | A1 * | 1/2004 | Voorhis et al. | 431/328 |
| 2005/0000957 | A1 | 1/2005 | Jones et al. | |
| 2007/0221192 | A1 * | 9/2007 | Chung | 126/39 E |
| 2010/0291501 | A1 * | 11/2010 | Smit | 431/354 |

FOREIGN PATENT DOCUMENTS

| | | | | |
|---|---|---|---|---|
| DE | 1237962 | B | 4/1967 | |
| DE | 19745767 | C1 * | 3/1999 | F23D 14/10 |
| DE | 19941275 | A1 * | 4/2001 | F23D 14/70 |
| DE | 10004159 | A1 * | 8/2001 | F23D 14/10 |
| EP | 1030107 | A1 * | 8/2000 | F23D 14/58 |
| FR | 2050830 | A5 | 4/1971 | |
| FR | 2050830 | A5 | 5/1971 | |
| GB | 2105026 | A * | 3/1983 | F23D 13/36 |
| JP | 58181126 | | 12/1983 | |
| JP | 03013703 | A * | 1/1991 | F23D 14/04 |
| JP | 06307611 | A * | 11/1994 | F23D 14/10 |
| JP | 07167412 | A * | 7/1995 | F23D 14/14 |
| JP | 08312922 | A * | 11/1996 | F23D 14/02 |
| JP | 09014611 | * | 1/1997 | |
| JP | 11-051327 | A | 2/1999 | |
| JP | 11051327 | A * | 2/1999 | F23D 14/08 |
| JP | 2001-198016 | A | 7/2001 | |
| JP | 2008-008569 | A | 1/2008 | |
| JP | 2008008569 | A * | 1/2008 | |
| WO | WO 2008140301 | A1 * | 11/2008 | F23D 14/04 |

OTHER PUBLICATIONS

European Search Report dated Dec. 6, 2012 corresponding to European Patent Application No. 09707890.1, 10 pages.

Japanese Office Action dated Aug. 28, 2012 for corresponding Japanese Patent Application 2010-543292 with English translation.

Canadian Office Action dated Sep. 4, 2012 corresponding to Canadian Patent Application No. 2712227.

China Office Action dated Sep. 27, 2011, corresponding to the Chinese Patent Application No. 200980102470.6.

Canadian Patent Office action dated May 8, 2013 from corresponding Canadian Patent Application No. 2,712,227, pp. 3.

International Search Report dated Mar. 3, 2009 issued in the corresponding International Application No. PCT/US2009/031328.

Office Action dated Jan. 7, 2014 for corresponding Japanese patent application No. JP2010-543292 with English translation, pp. 11.

Notification of Reexamination by Chinese Patent Office on Sep. 23, 2012 for Chinese Patent Application No. 200980102470.6 with English translation, pp. 12.

Search Report and Examination dated Dec. 31, 2013 for corresponding Malaysian patent application No. PI2010003340, pp. 3.

Mexican Office Action dated Jul. 2, 2013 corresponding to Mexican Patent Application No. MX/a/2010/007766, 6 pp.

Office Action dated Dec. 11, 2013 for corresponding Mexico patent application No. MX/a/2010/007766 with English translation, pp. 12.

Final Office Action dated Apr. 2, 2013 for corresponding Japanese patent application No. JP2010-543292 with English translation, pp. 12.

* cited by examiner

OPEN LOOP GAS BURNER

CROSS-REFERENCE TO RELATED APPLICATIONS

The present application claims priority to U.S. Provisional Application No. 61/011,520, filed on Jan. 18, 2008.

BACKGROUND OF THE INVENTION

1. Field of the Invention

The present disclosure relates to a gas burner having an open loop geometry that achieves uniform or distributed flame characteristics, uniform or distributed heating conditions and an even pressure distribution throughout the burner.

2. Description of Related Art

Traditional gas burners are used in grill and griddle assemblies to heat a cooking surface. There are two types of gas burners that are commonly used that include an atmospheric burner and a powered burner. The atmospheric burner relies solely on static pressure of the gas from a gas supply to provide an air-gas mixture at various burner ports where the air-gas mixture may be ignited to create a flame. The powered burner utilizes a fan or blower and is connected to a supply of gas prior to an inlet of the burner in order to enhance the mixing of air and gas and to further provide the air-gas mixture to the burner at a pressure that is generally higher than atmospheric pressure.

Traditional gas burners exhibit performance deficiencies due to non-uniform flame characteristics, non-uniform heating conditions and uneven pressure distribution that are inherent with the design of the burner. Non-uniform flame characteristics of traditional gas burners often create the non-uniform heating conditions on the cooking surface. These non-uniform heating conditions manifest themselves as localized hot or cold spots along the cooking surface resulting in unpredictable and inconsistent cooking.

Non-uniform flame characteristics are primarily a result of the geometry of the gas burner. The closed loop geometry has a flue on the back end of the burner that results in all of the flue gas migrating to that particular region. The migration of the flue gas to the back end results in an excess heat build-up in that region and consequently, there are non-uniform flame characteristics and non-uniform heating conditions.

The uneven pressure distribution in traditional gas burners is primarily a result of the positioning of the diffuser directly under the ports of the burner. This configuration does not provide a space for the gas to even out the pressure above the diffuser because of the close proximity of the ports. The uneven pressure distribution created by the positioning of the diffuser can also result in popping, flashback, or excess flame lifting because of the non-uniform distribution of gas throughout the distribution section of the gas burner. Furthermore, the location of the diffuser and the inlet in traditional gas burners gives the burner a front to rear overall dimension that can lead to packaging difficulties. It would be more advantageous to have a final assembly that is shorter from the front to rear of the gas burner.

Accordingly, there is a need for a gas burner that achieves uniform or distributed flame characteristics as needed, uniform or distributed heating conditions and an even pressure distribution throughout the burner. Furthermore, a gas burner is needed that has a geometry that provides stable combustion, eliminates popping and flashback, and has improved overall energy efficiency.

SUMMARY OF THE INVENTION

The present disclosure provides a gas burner having an open loop geometry that achieves uniform flame characteristics distributed from a plurality of burner ports. The plurality of burner ports are distributed to obtain an even temperature distribution on the surface being heated by the burner.

The present disclosure further provides a gas burner having an air-gas mixture distribution section with uniform or distributed heating conditions and even pressure distribution throughout the burner. The air-gas mixture distribution section provides fully mixed air and gas that is delivered to the burner ports.

The present disclosure still further provides an inlet to the air-gas mixture distribution section that is coupled to a supply of combustible gas.

The present disclosure also provides a gas burner having a fan coupled to the inlet of the burner that mixes air with a combustible gas and provides it to the gas burner at an increased pressure.

The present disclosure yet further provides that the ports of the burner have several slots formed into a substantially flat upper surface of the air-gas mixture distribution section and arranged to balance the thermal characteristics of the burner. The ports are configured to form a pattern that is designed to provide the desired temperature distribution to the surface being heated. In one embodiment, the ports are arranged in an array that has sequences of port rows interleaved with sequences of port columns.

The present disclosure also provides a gas burner having a distribution diffuser located near the inlet to the air-gas distribution section. The distribution diffuser is located between the inlet to the air-gas mixture distribution section and the top heating surface and extends along the sides of the burner to such a distance so that the pressure of the air-gas mixture within the burner is balanced. This geometry provides a bottom fuel entry instead of the traditional front fuel entry, though the present disclosure also contemplates the use of the traditional front entry.

These and other advantages and benefits of the present disclosure are provided by a gas burner having an air-gas mixture distribution section formed in an open loop geometry. The gas burner can have any number of sides designed to provide an open loop geometry. In one embodiment, the gas burner has a first side, a second side and a third side. The air-gas mixture distribution section has a top heating surface. A plurality of ports are disposed on the top heating surface. The air-gas mixture distribution section has an inlet disposed thereon and a distribution diffuser mounted therein.

The above-described and other features and advantages of the present disclosure will be appreciated and understood by those skilled in the art from the following detailed description, drawings, and appended claims.

DETAILED DESCRIPTION OF THE INVENTION

Figure 1:
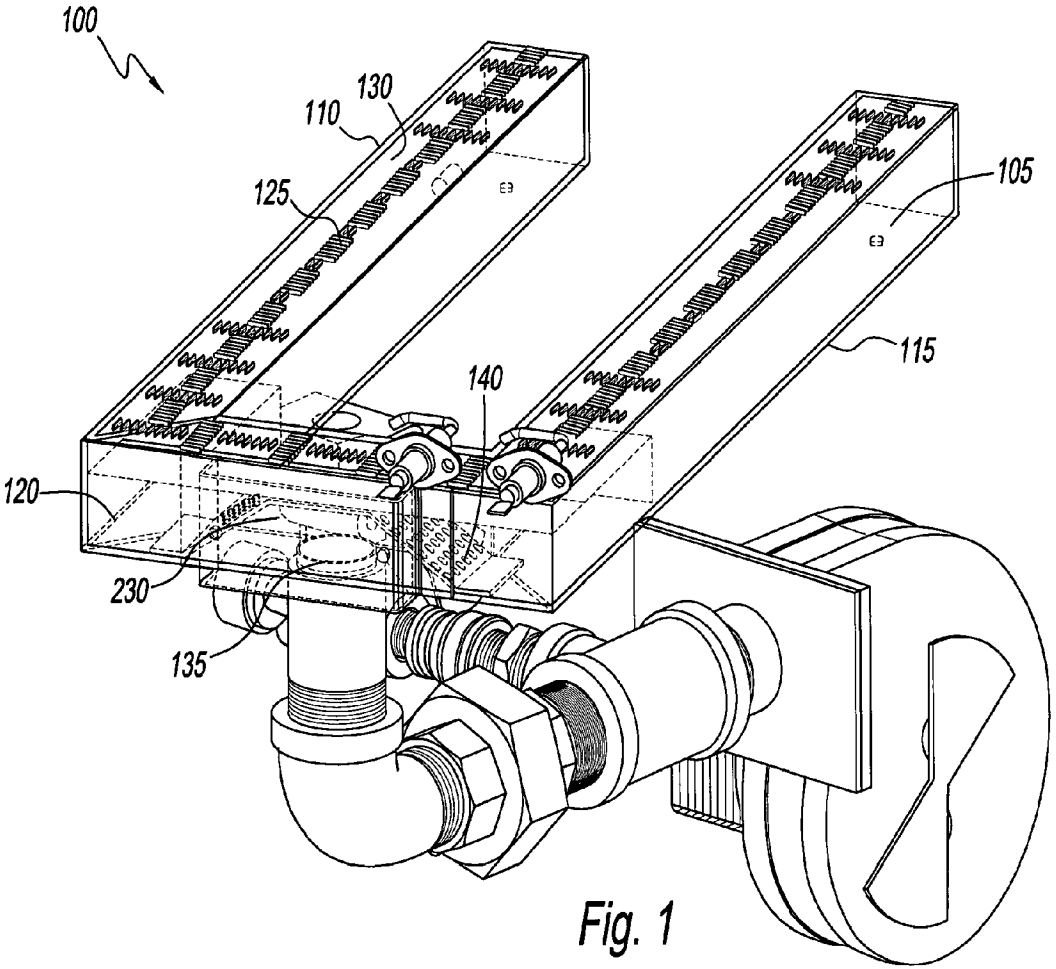
FIG. 1 is a right-side perspective view of a first embodiment of the gas burner of the present disclosure having an open loop geometry.
Figure 2:
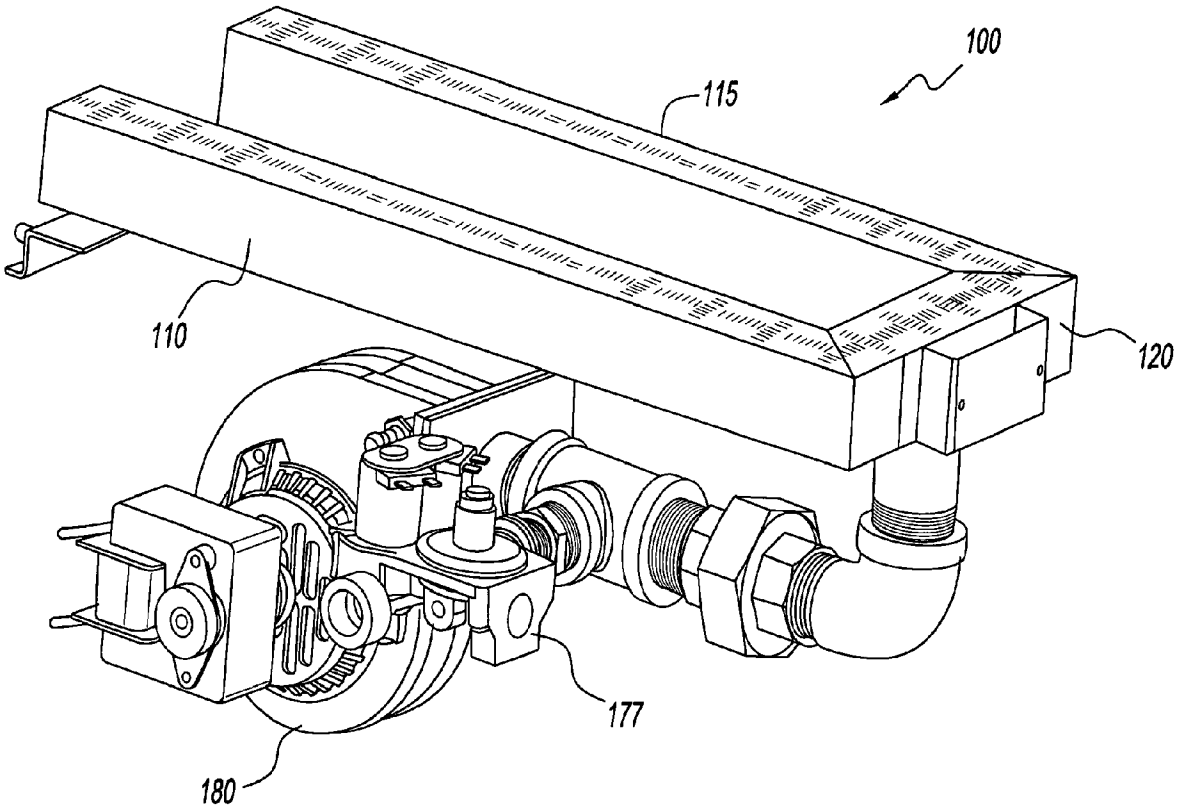
FIG. 2 is a left-side perspective view of the gas burner of FIG. 1.

Referring to the drawings and, in particular, FIG. 1, a gas burner generally referred to by reference number 100 is shown. In one embodiment, gas burner 100 has an air-gas mixture distribution section 105. Air-gas mixture distribution section 105 has an open loop, or U-shaped geometry, that has a plurality of sides. In one embodiment, air-gas mixture distribution section 105 has two long sides 110 and 115 and one short side 120. A plurality of apertures or ports 125 are disposed on a top heating surface 130 of air-gas mixture distribution section 105 that in the present configuration is substantially flat. Gas burner 100 further includes an inlet 135 at an end of air-gas mixture distribution section 105. A distribution diffuser 140 is provided near inlet 135.

The gas burner 100 of the present disclosure advantageously utilizes heat more efficiently because there are no burner ports disposed at the back end of the burner and thus, there is an outlet for flue gases to escape. The open loop geometry of gas burner 100 provides a natural heat convection through the back end of the burner because it eliminates heat where it is not needed. The hot flue gases in the back end provide residual heat to that area of the burner. Furthermore, gas burner 100 is more energy efficient because a smaller quantity of gas is necessary to achieve the same thermal characteristics. Flame stability is improved because less input is needed to achieve the desired temperature distribution. In addition, gas burner 100 has improved control and accuracy, and has made packaging the burner easier because of the flexibility of the design.

Distribution diffuser 140 provides an even pressure distribution to air-gas mixture distribution section 105. The even distribution of pressure further helps to provide uniform or distributed flame characteristics to ports 125. In one embodiment, distribution diffuser 140 is located between the inlet 135 and top heating surface 130 in such a way as to balance the pressure of the air-gas mixture within burner 100. Distribution diffuser 140 can also extend along long sides 110, 115 to a distance sufficient to balance the pressure of the air-gas mixture within burner 100.

Figure 5:
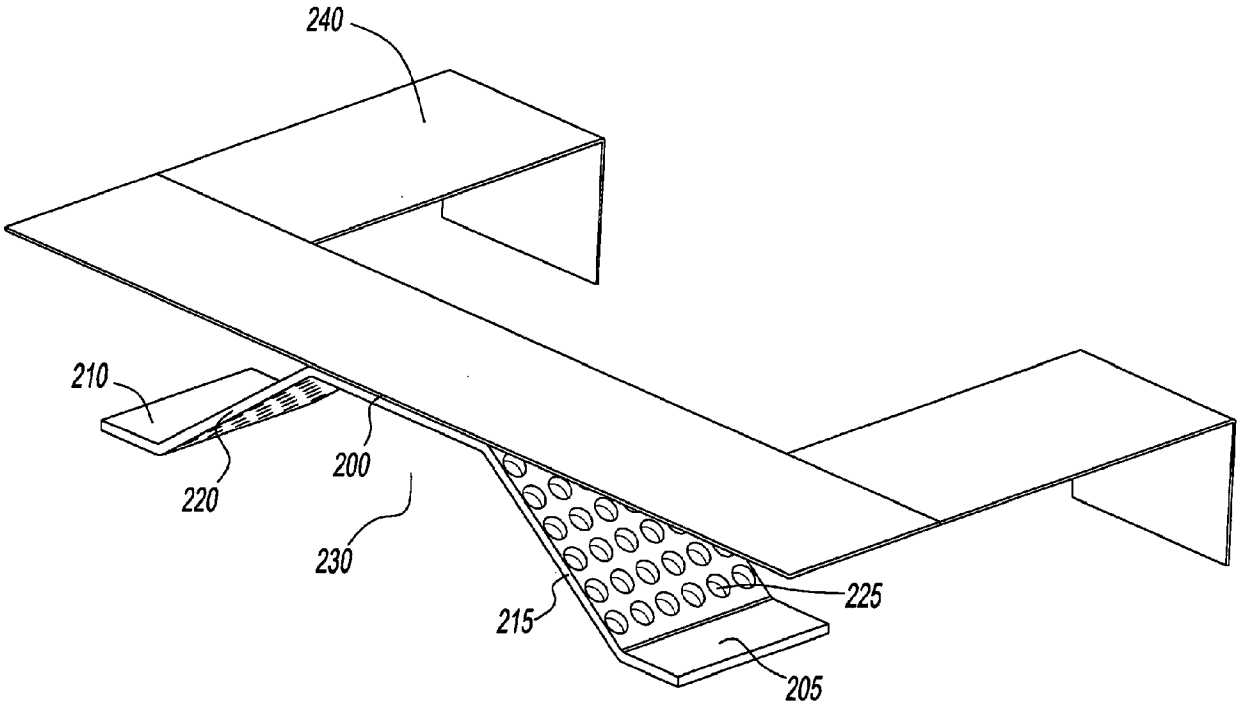
FIG. 5 is a perspective view of the distribution diffuser of FIG. 1.

Referring specifically to FIG. 5, distribution diffuser 140 is shown having a top surface 200, two bottom surfaces 205, 210 and two side surfaces 215, 220. Side surfaces 215, 220 have a plurality of holes 225 therein. Top surface 200 can be made of a fine mesh screen. The configuration of distribution diffuser 140 is advantageous because it creates a lower chamber 230 disposed below top surface 200, and between side surfaces 215 and 220. The gas pressure can even out within lower chamber 230, and then be distributed through the entire air-gas mixture distribution section 105 more evenly.

This configuration is also advantageous because it provides for a bottom fuel entry instead of the traditional front fuel entry. Also, this configuration provides additional unexpected results that include uniform or distributed flame characteristics, uniform or distributed heating conditions and an even pressure distribution throughout burner 100. Another advantage of having this configuration of distribution diffuser 140 is that it makes manufacturing easier because there is flexibility in where the fuel can enter air-gas mixture distribution section 105. Furthermore, popping and flashback are eliminated in the aforementioned design of distribution diffuser 140. The present disclosure also contemplates a front fuel entry to air-gas distribution section 105.

Diffuser 140 can have screen 240 that is connected to top surface 220. Screen 240 can extend along short side 120, and at least partially along long sides 110 and 115. Screen 240 thus further assists in the balancing of the air-gas mixture pressure within distribution section 105. Screen 240 can be made from a meshed material, so that the air-gas mixture can pass through it, and out of ports 125.

Figure 3:
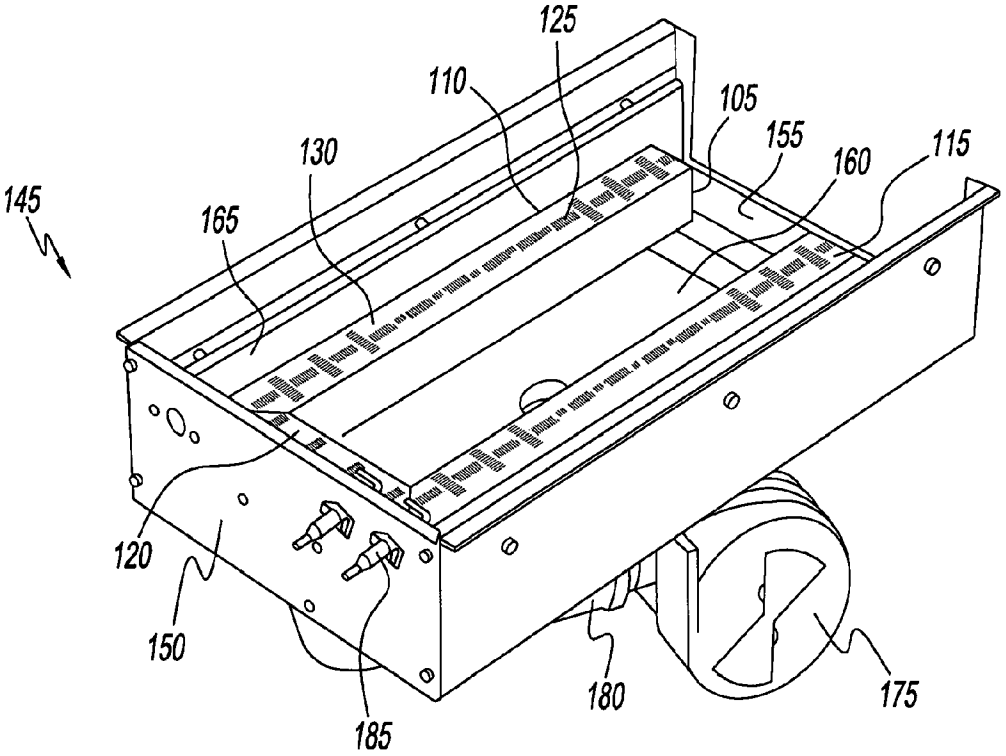
FIG. 3 is a perspective view of the gas burner of FIG. 1, in which the gas burner is depicted in a burner tray assembly.

Referring to FIG. 3, the gas burner 100 can be installed within a burner tray assembly 145. Burner tray assembly 145 includes a front wall 150, a back wall 155 and a bottom wall 160. In one embodiment, burner tray assembly 145 has an insulation layer 165 disposed therein. Insulation layer 165 is disposed along the interior of front wall 150, back wall 155 and bottom wall 160. Insulation layer 165 can comprise an insulation material. Alternatively, there can be a layer of air disposed along the interior of front wall 150, back wall 155 and bottom wall 160, to provide insulation. In another embodiment, burner tray assembly 145 has a temperature sensor 170. Temperature sensor 170 extends through bottom wall 160 and through an open region approximately centrally located in burner heating area of gas burner 100.

Gas burner 100 is controlled by valving that includes a gas inlet valve 177, a blower 175 and a feed pipe 180. Inlet valve 177 and blower 180 are in fluid communication with feed pipe 180 and provide air and gas to feed pipe 180. Feed pipe 180 extends through front wall 150, and is in fluid communication with distribution section 105, to provide an air-gas mixture to gas burner 100. Blower 175 facilitates the mixing of the air with the gas and further provides the air-gas mixture to gas burner 100 that is at a pressure greater than atmospheric pressure. An igniter 185 also extends through front wall 150 to ignite the fuel flow that is at top heating surface 130 of gas burner 100. In one embodiment, a controller (not shown) can operate inlet valve 177, blower 175 and igniter 185 automatically. In another embodiment, inlet valve 177, blower 175 and igniter 185 can be operated manually.

Figure 4:
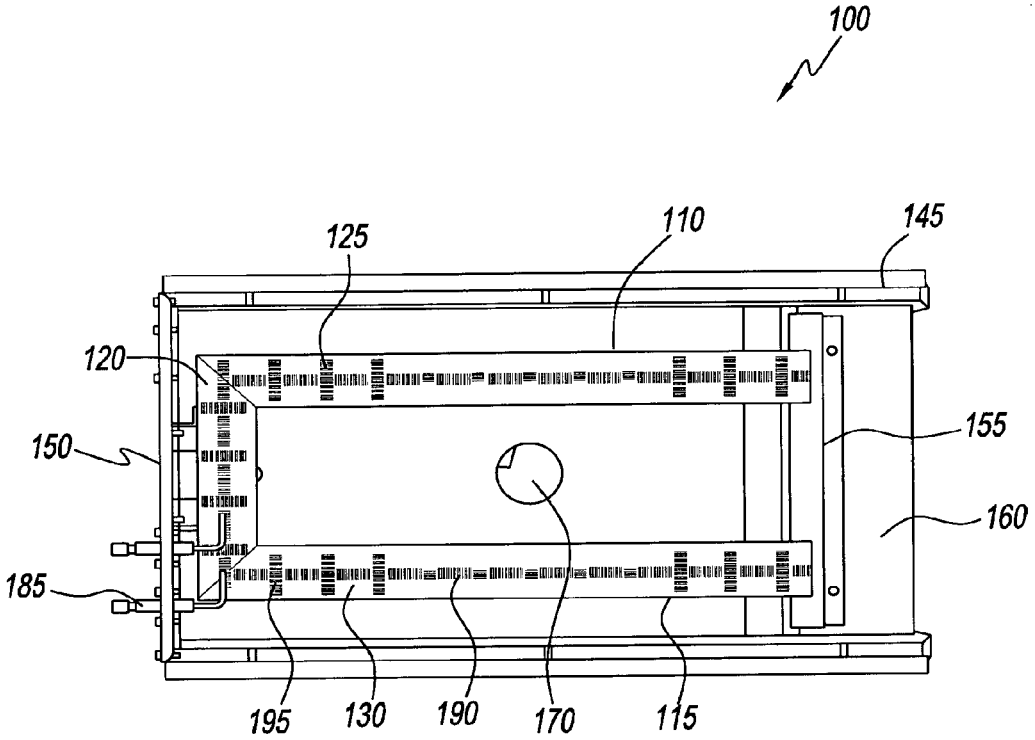
FIG. 4 is top plan view of the gas burner of FIG. 1, in which the gas burner is mounted in the burner tray assembly of FIG. 3.

Referring now to FIG. 4, an overhead view of gas burner 100 is shown. In one embodiment, ports 125 can be in an array that has sequences of port rows 190 interleaved with sequences of port columns 195. In one embodiment, ports 125 have an elongated rectangular or slot shape so that there are uniform or distributed flame characteristics throughout the entire top heating surface 130. The array has a lesser number of ports 125 in the portions of long sides 110 and 115 in the vicinity of temperature sensor 170 than in all other portions of gas burner 100. In another embodiment, ports 125 can have any other arrangement that provides uniform or distributed flame characteristics and uniform or distributed heating conditions to the surface above gas burner 100. For example, ports 125 can be oriented substantially transverse or parallel to a longitudinal axis off long sides 110 and 115 and short side 120 of gas burner 100. Ports 125 can be holes, slots or any other shape that effectively releases a combustible gas. The port array provides gas burner 100 with a substantially uniform heat distribution and optimal thermal characteristics.

In the shown embodiments, long sides 110 and 115, and short side 120, of air-gas distribution section 105 are a series of rectangular or square shapes. The present disclosure, however, also contemplates other shapes for the sides of the air-gas distribution section 105, such as round, obround, triangular, and others suitable for providing flame to the surface to be heated.

Figure 6:
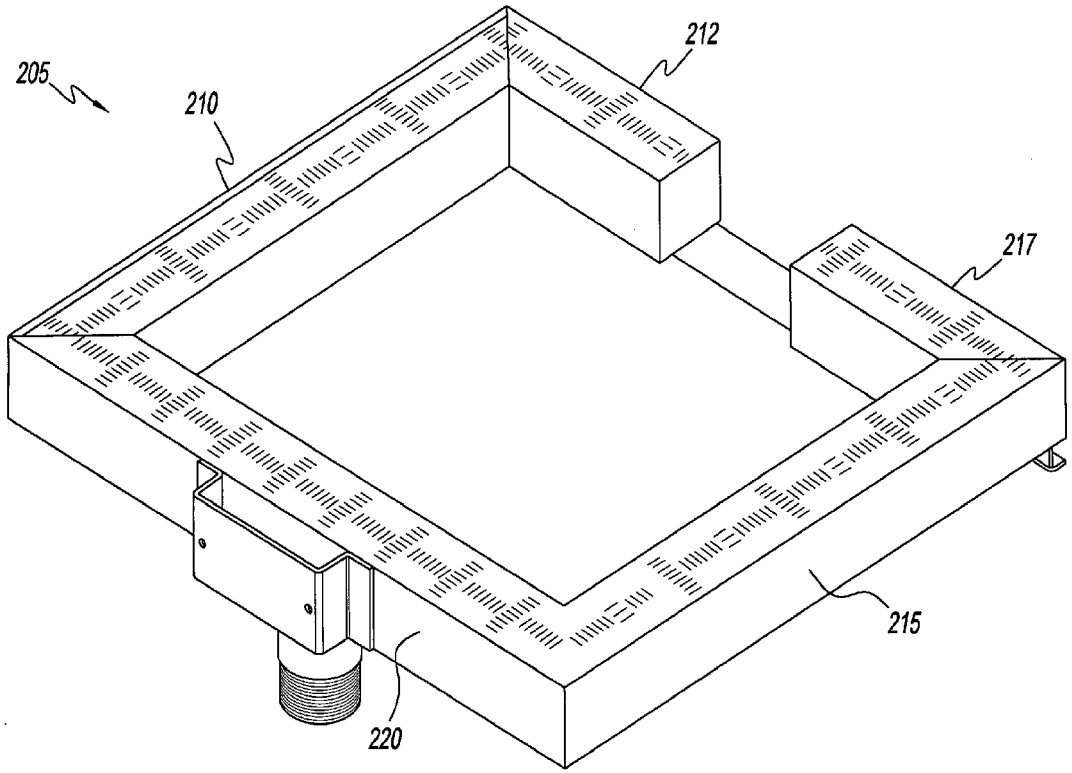
FIG. 6 is a right-side perspective view of a second embodiment of the air-gas distribution section used in the gas burner of FIG. 1.
Figure 7:
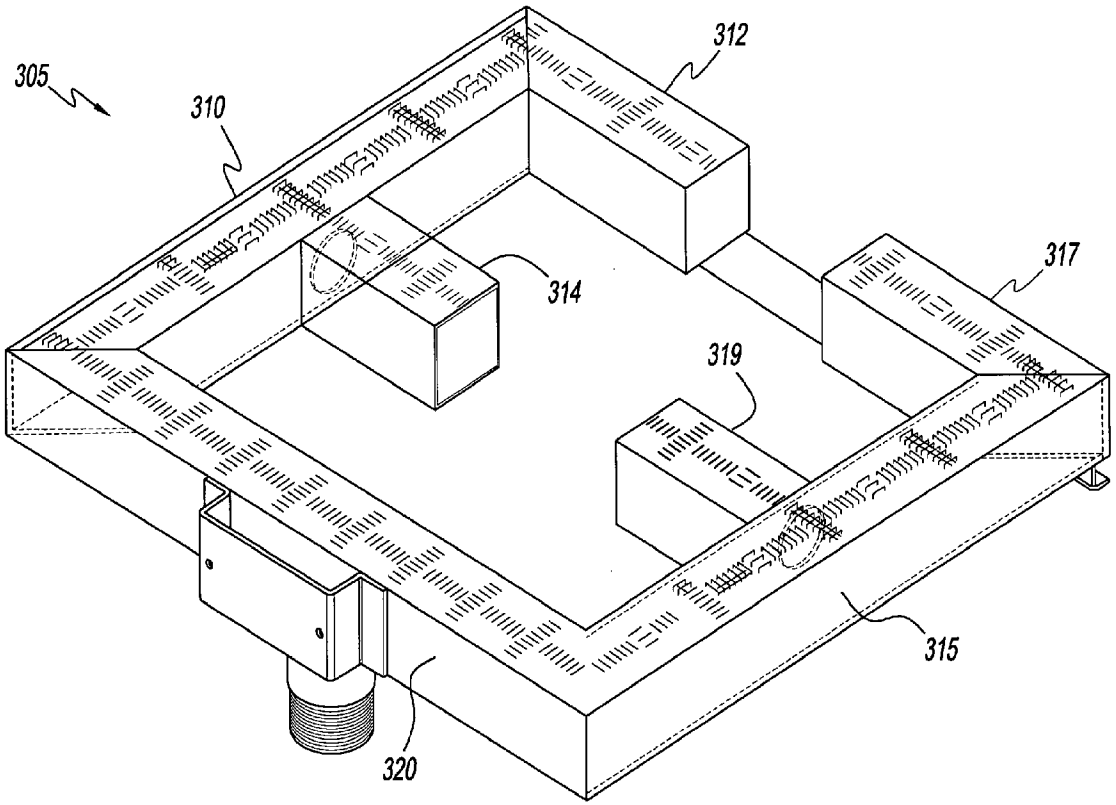
FIG. 7 is a right-side perspective view of a third embodiment of the air-gas distribution section used in the gas burner of FIG. 1.

Referring to FIGS. 6 and 7, alternative configurations for the air-gas distribution section of the present disclosure are shown. As shown in FIG. 6, air-gas distribution section 205 has base side 220, left side 210, and right side 215. Left side 210 and right side 215 further have end burner sections 212 and 217, respectively, connected thereto. End burner sections 212 and 217 project toward each other in a direction away from left side 210 and right side 215, respectively, and thus provide enhanced coverage for heating the surface that is located above air-gas distribution section 205 when burner 100 is in use. Distribution section 205 thus resembles a square or rectangle with an opening at one end. The open-loop geometry, and all of the advantages of the same discussed above, is maintained in this arrangement.

As shown in FIG. 7, air-gas distribution section 305 has base side 320, left side 310, and right side 315. Left side 310 and right side 315 further have end burner sections 312 and 317, respectively, connected thereto. End burner sections 312 and 317 project toward each other in a direction away from left side 310 and right side 315, respectively. In addition, left side 310 and right side 315 have intermediate burner sections 314 and 319, respectively. Left intermediate burner section 314 and right intermediate burner section 319 are connected to left side 310 and right side 315 at approximately midway along the length of these sides, and project into the middle of air-gas distribution section 305. Again, this arrangement provides enhanced coverage for heating a surface, while still maintaining open-loop geometry. Either of distribution sections 205 or 305 can be used in burner 100.

While the present disclosure has been described with reference to one or more embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiments disclosed as the best mode contemplated, but that the disclosure will include all embodiments falling within the scope of the appended claims.

What is claimed is:

1. A gas burner, comprising:

an air-gas mixture distribution section comprising a first side, a second side, and a third side formed in a U-shaped open loop geometry;

a top heating surface on said air-gas mixture distribution section having a plurality of ports disposed thereon;

an inlet disposed on a bottom surface of said first side of said air-gas mixture distribution section, for receiving an air-gas mixture, wherein said bottom surface is opposite to said top heating surface;

a gas inlet valve;

a combustion blower;

a feed pipe, wherein said feed pipe is in fluid communication with said inlet, said gas inlet valve, and said combustion blower; and a distribution diffuser mounted within said first side of said air-gas mixture distribution section, between said inlet and said top heating surface, so that a chamber is between said distribution diffuser and said inlet, within said first side of said distribution section, and wherein said distribution diffuser has a top surface that substantially conforms to an underside of said top heating surface within said first side, and extends at least partially along said second and said third side, wherein said distribution section and said distribution diffuser evenly distribute the pressure of the air-gas mixture within the gas burner.

2. The gas burner of claim 1, wherein said first side is shorter than both said second side and said third side.

3. The gas burner of claim 1, wherein said top heating surface is substantially flat.

4. The gas burner of claim 1, wherein the gas burner is mounted in a burner tray assembly.

5. The gas burner of claim 1, wherein said plurality of ports are arranged in sequences of ports that are parallel and transverse to a longitudinal axis of said sides.

6. The gas burner of claim 5, wherein said pattern of ports delivers a uniform or distributed heat pattern to evenly heat a surface above said distribution section.

7. The gas burner of claim 1, wherein each of said first side, said second side, and said third side are straight, rectangular sections.

8. The gas burner of claim 1, wherein said top surface of said distribution diffuser is a fine mesh screen that extends at least partially along said second and said third side of said air-gas mixture distribution section.

9. A burner tray assembly comprising:

a front wall, a back wall and a bottom wall having a gas burner mounted therein, said gas burner having an air-gas mixture distribution section comprising a first side, a second side, and a third side, formed in a U-shaped open loop geometry;

an insulation layer disposed along an interior of said front wall, said back wall and said bottom wall;

a temperature sensor extending through said bottom wall;

an inlet disposed on a bottom surface of said first side of said air-gas mixture distribution section, for receiving the air-gas mixture, wherein said bottom surface is opposite to said top heating surface;

a gas inlet valve;

a combustion blower;

a distribution diffuser mounted in said first side of said air-gas mixture distribution section, between said inlet and said top heating surface, so that a chamber is between said distribution diffuser and said inlet, within said first side of said distribution section, and wherein said distribution diffuser has a top surface that substantially conforms to an underside of said top heating surface within said first side, and extends at least partially along said second and said third side to a distance sufficient to balance the pressure in said gas burner and to provide uniform or distributed flame characteristics for said distribution section; and a feed pipe, wherein said feed pipe is in fluid communication with said inlet, said gas inlet valve, and said combustion blower.

10. The burner tray assembly of claim 9, wherein each of said sides has a top heating surface.

11. The burner tray assembly of claim 10, wherein said top heating surface has a plurality of ports disposed thereon.

12. The burner tray assembly of claim 9, wherein said first side of said air-gas mixture distribution section has an inlet disposed thereon.

* * * * *